United States Patent [19]

Logie et al.

[11] Patent Number: 4,587,505

[45] Date of Patent: May 6, 1986

[54] PLURAL COIL CONNECTION MEANS IN AN ELECTROMAGNETIC DEVICE

[75] Inventors: Frank M. Logie, London; George Vine, Barming; Brian J. Tidmarsh, Pinner; James C. Potter, London, all of England

[73] Assignee: Lucas Industries Public Limited Company, Birmingham, England

[21] Appl. No.: 661,786

[22] Filed: Oct. 16, 1984

[30] Foreign Application Priority Data

Oct. 22, 1983 [GB] United Kingdom ..... 8328306

[51] Int. Cl.[4] ..... H01F 7/08

[52] U.S. Cl. ..... 335/266; 310/27; 335/281

[58] Field of Search ..... 335/261, 266, 276, 281, 335/282; 310/27

[56] References Cited

U.S. PATENT DOCUMENTS 2,987,656 6/1961 Handshuh et al. ..... 335/268

4,326,139 4/1982 Mowbray ..... 310/27

*Primary Examiner*—George Harris

[57] ABSTRACT

An electromagnetic device includes a stator structure defining spaced circumferential grooves in which are wound windings. Pole pieces are disposed between adjacent grooves and each pole piece has an axial slot in its periphery and a tangential slot formed in one side face, the tangential slot extending from the axial slot to adjacent the base wall of the groove. The slots accommodate the interconnection between the windings in adjacent grooves.

6 Claims, 6 Drawing Figures

PLURAL COIL CONNECTION MEANS IN AN ELECTROMAGNETIC DEVICE

This invention relates to electromagnetic devices of the kind comprising a stator structure and an annular armature surrounding the stator structure, said stator structure defining a plurality of axially spaced circumferential grooves with circumferential pole pieces defined between adjacent grooves respectively and windings in said grooves, said windings being connected in series to form a composite winding the end connections of which extend from one end of the stator structure.

It is known to form in the stator structure an axially extending radial slot which extends to a depth below the depths of the aforesaid grooves and to start winding the windings in turn from the opposite end of the stator structure to the end from which the end connections extend. The initial stage in the winding of the windings is to lay an end connection at the base of the aforesaid slot and then to wind the windings in the groove furthest from said one end of the structure. When the winding in the aforesaid groove is completed the wire is passed through the portion of the slot in the adjacent pole piece into the adjacent groove. If the wire is under tension, as is usually the case, the wire will extend in a tangential direction to the base of the next groove. As a result there will be a loss of winding space because of the fact that the wire passes in a tangential direction along the side wall of the groove and in addition since the wire is passing through an axial slot and is changing direction both as it enters and leaves the slot, the wire is in firm engagement with two edges of the slot which must therefore be carefully deburred and ideally radiused to minimise damage to the insulation of the wire. In practice the direction of winding the windings in adjacent grooves may be opposite.

The object of the present invention is to provide an electromagnetic device of the kind specified in a simple and convenient form.

According to the invention each pole piece lying between a pair of grooves has an axial slot in its peripheral surface and one side face of the pole piece is provided with a tangential slot extending from said axial slot to the base wall of the respective groove, said tangential slot extending in the direction appropriate to the winding direction in that groove, the axial and tangential slots acting to accommodate the interconnection between adjacent windings.

An example of an electromagnetic device in accordance with the invention will now be described with reference to the accompanying drawings in which.

Figure 1:
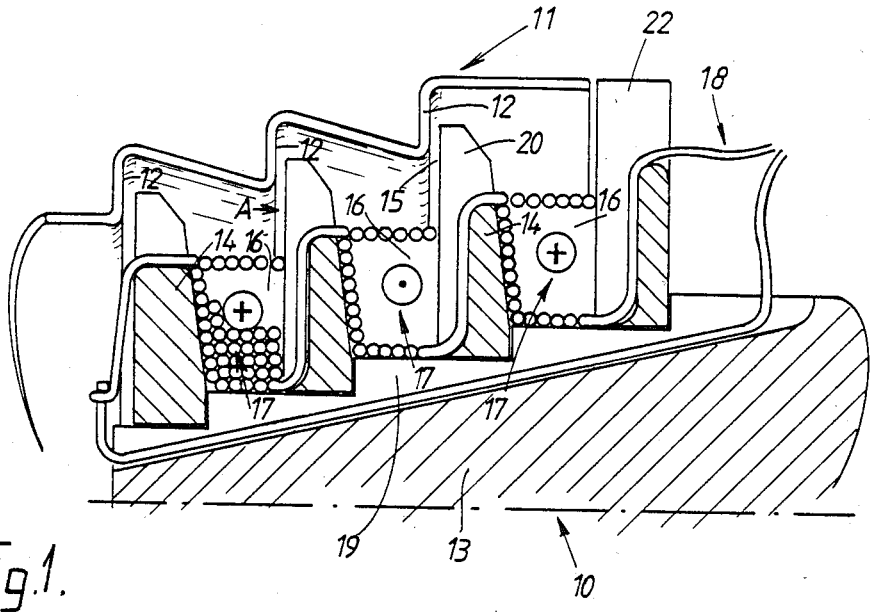
FIG. 1 is a sectional side elevation through one half of the device.

Referring to FIG. 1 of the drawings, the electromagnetic device is in the form of a linear actuator and comprises a stator structure 10 which is surrounded by an annular armature 11. The armature 11 is formed from magnetisable material and defines on its internal peripheral surface, annular radially extending and axially spaced pole faces 12.

The stator structure 10 comprises a magnetisable core member 13 upon which is mounted a plurality of pole pieces 14, the core and pole pieces being formed from magnetisable material. The pole pieces are of annular form and are axially spaced conveniently being located against steps formed on the core member. The pole pieces 14 each define annular pole faces 15 which are presented to the pole faces 12 respectively of the armature.

Between adjacent pole pieces grooves 16 are defined, the grooves accommodating windings 17 which are connected in series to form a composite winding the end connections 18 of which extend from one end of the stator structure. Adjacent windings are wound in opposite directions so that when electric current is passed through the composite winding, adjacent pole pieces 14 will assume opposite magnetic polarity and attraction forces will be developed between the pole faces 12 and 15 to cause relative movement of the armature and stator structure.

In the example the pole pieces 14 are pressed into position on the core member prior to the winding of the winding but before the pole pieces are placed in position, an axially extending slot 19 is formed in the core member, the slot being of such a depth as to be able to accommodate one of the end connections 18. The end connection in the slot 19 is preferably a suitably insulated conductor which preferably is placed in position before the pole pieces are placed in position on the core member.

Figure 2:
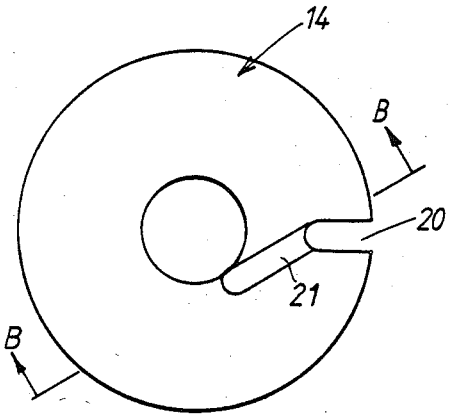
FIG. 2 is a view in the direction of the arrow A of FIG. 1 of a part of the device.
Figure 3:
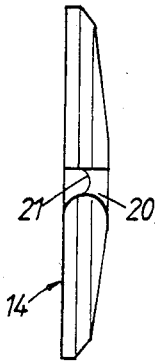
FIG. 3 is an edge view of the part shown in FIG. 2.
Figure 4:
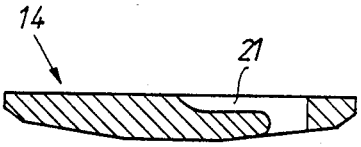
FIG. 4 is a section taken along the line B—B of FIG. 2.

Before being pressed into position, the pole pieces 14 are each provided with an axial and a tangential slot. Referring to FIGS. 2–4, each pole piece is provided with an axial slot 20 the depth of which is such that its base wall will lie at least the diameter of a conductor below the completed height of the winding in the adjacent groove. The tangential slot 21 is formed in one side wall of the pole piece and extends from the base of the slot 20 to a position which in practice is adjacent the base wall of the groove 16 the side wall of which is defined by the face of the pole piece in which the slot 21 is formed. As mentioned, adjacent windings are wound in opposite directions and the direction of the slot 21 must be appropriate to the direction in which the winding in the associated groove is wound. The edge of the slot 20 about which the winding will in use extend, is carefully deburred and as illustrated in FIG. 3, is preferably radiused. The depth of the slot 21 is slightly greater than the diameter of the conductor.

In constructing the stator structure the pole pieces are pressed into position preferably with the axial slots 20 therein in alignment. Winding commences in the groove which is nearest to the end of the stator structure from which the end connections 18 extend. The end plate of this groove indicated at 22 in FIG. 1 is also provided with slots equivalent to the slots 20 and 21 in the pole pieces 14. When the winding in the aforesaid groove has been completed the wire is passed through the axial slot of the adjacent pole piece and will naturally since the tangential slot 21 in that pole piece extends in the correct direction, fall into the tangential slot so that it will not occupy any space which can be filled by the winding in that groove. The process is then repeated for the remaining groove or grooves and a connection is made with the insulated conductor passing through the slot 19. It will be noted in FIG. 1, that the pole piece 14 which is at the end of the stator structure remote from that end at which winding commenced is not provided with a tangential slot since such is not necessary.

Using the arrangement described the whole section of the grooves is available to accommodate a winding and the stress imposed upon the portions of the wire connecting the windings is minimised.

Figure 6:
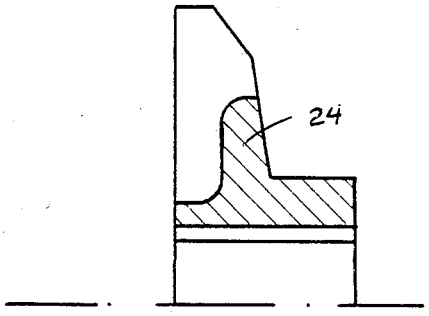
FIG. 6 shows a third embodiment of the device.
Figure 5:
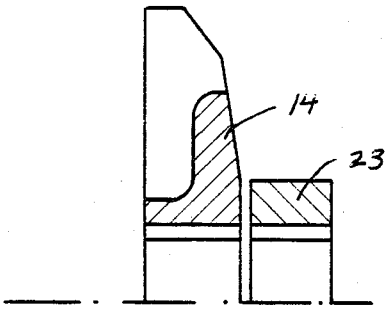
FIG. 5 shows a second embodiment of the device.

The core member 13 which is solid in the example shown in FIG. 1, may comprise a plurality of magnetisable spacer members 23 which are positioned between the adjacent pole pieces respectively as shown in FIG. 5, the assembly being held in assembled relationship by a suitable clamping means. If desired however each spacer member can be associated with and be formed integrally with one of the pole pieces as shown by reference numeral 24 in FIG. 6.

It is possible with the arrangement described, to commence winding at the opposite end of the stator structure. In this case it is merely necessary to ensure that the tangential slots 21 extend in the appropriate direction. This method of winding is less satisfactory because the last layer of the last winding will not be anchored. In the construction described with reference to the drawing the last layer is secured to the insulated conductor which passes through the groove and this serves to anchor the winding.

As an alternative to the axial slot 19 in the core member 13, the latter may be provided with a longitudinal bore which need not be on the axis or even parallel thereto. The insulated conductor can then be fitted at any stage of assembly.

We claim:

1. An electromagnetic device comprising a stator structure and an annular armature surrounding the stator structure, said stator structure defining a plurality of axially spaced circumferential grooves, circumferential pole pieces defined between adjacent grooves respectively, windings in said grooves, said windings being connected in series to form a composite winding the end connections of which extend from one end of the stator structure, each pole piece lying between a pair of grooves having an axial slot in its peripheral surface and one side face of the pole piece being provided with a tangential slot extending from the axial slot to the base wall of the respective groove, said tangential slot extending in the direction appropriate to the winding direction in that groove, the axial and tangential slots acting to accommodate the interconnection between adjacent windings.

2. An electromagnetic device according to claim 1 in which said stator structure includes a cone member, said pole pieces being pressed onto said core member.

3. An electromagnetic device according to claim 2 in which said core member is of stepped form and said pole pieces are located against the steps respectively.

4. An electromagnetic device according to claim 2 or claim 3 including an axial slot formed in the core member, said axial slot in use conveying an end connection.

5. An electromagnetic device according to claim 1 including a core structure which is formed by a plurality of magnetisable spacer members located between ajdacent pole pieces respectively.

6. An electromagnetic device according to claim 5 in which each spacer member is integral with an adjacent pole piece.

* * * * *